United States Patent [19]

Goetschius

[11] Patent Number: 4,512,389

[45] Date of Patent: Apr. 23, 1985

[54] HEAT TRANSFER ELEMENT ASSEMBLY

[75] Inventor: Gary C. Goetschius, Wellsville, N.Y.

[73] Assignee: The Air Preheater Company, Inc., Wellsville, N.Y.

[21] Appl. No.: 562,655

[22] Filed: Dec. 19, 1983

[51] Int. Cl.[3] ..... F28D 19/00

[52] U.S. Cl. ..... 165/10; 165/8

[58] Field of Search ..... 165/8, 10

[56] References Cited

U.S. PATENT DOCUMENTS 2,696,976 12/1954 Boestad et al. ..... 165/10

FOREIGN PATENT DOCUMENTS 1059161 11/1953 France ..... 165/10

*Primary Examiner*—Albert W. Davis, Jr.

*Attorney, Agent, or Firm*—William W. Habelt

[57] ABSTRACT

A rotary regenerative heat exchanger (2) for transferring heat from a hot fluid to a cold fluid by means of an assembly (30) of heat transfer element which is alternately contacted with the hot and cold fluid. The heat transfer element assembly (30) is comprised of a plurality of first and second heat absorbent plates (32,34) stacked alternately in spaced relationship. The spacing between adjacent first and second plates (32,34) is maintained by spacers which comprise V-shaped folds (38A and 38B) crimped in the first plates (32) and second plates (34), respectively, at spaced intervals along the plates. The folds (38A) in the first plates (32) are spaced equally apart by a first interval, while the folds (38B) in the second plates (34) are also spaced equally apart but at a second interval which is not equal to the first interval. In this manner, the folds in adjacent plates will not line up and nesting of adjacent plates is precluded.

2 Claims, 2 Drawing Figures

HEAT TRANSFER ELEMENT ASSEMBLY

BACKGROUND OF THE INVENTION

The present invention relates to heat transfer element and, more specifically, to a heat transfer element assembly comprised of a stacked array of spaced absorbent plates for use in a rotary regenerative heat exchanger wherein the heat transfer element is heated by contact with the hot gaseous heat exchange fluid and thereafter brought in contact with a cool gaseous heat exchange fluid to which the heat transfer element gives up its heat.

One type of heat exchange apparatus to which the present invention has particular application is the well-known rotary regenerative heater. A typical rotary regenerative heater has a cylindrical rotor divided into compartments in which are disposed and supported spaced heat transfer plates which as the rotor turns are alternately exposed to a stream of heating gas and then upon rotation of the rotor to a stream of cooler air or other gaseous fluid to be heated. As the heat transfer plates are exposed to the heating gas, they absorb heat therefrom and then, when exposed to the cool air or other gaseous fluid to be heated, the heat absorbed from the heating gas by the heat transfer plates is transferred to the cooler gas. Most heat exchangers of this type have their heat transfer plates closely stacked in spaced relationship to provide a plurality of passageways between adjacent plates for flowing the heat exchange fluid therebetween.

In such a heat exchanger, the heat transfer capability of a heat exchanger of a given size is a function of the rate of heat transfer between the heat exchange fluid and the plate structure. However, for commercial devices, the utility of a device is determined not alone by the coefficient of heat transfer obtained, but also by other factors such as the resistance to flow of the heat exchange fluid through the device, i.e., the pressure drop, the ease of cleaning the flow passages, the structural integrity of the heat transfer plates, as well as factors such as cost and weight of the plate structure. Ideally, the heat transfer plates will induce a highly turbulent flow through the passages therebetween in order to increase heat transfer from the heat exchange fluid to the plates while at the same time providing relatively low resistance to flow between the passages and also presenting a surface configuration which is readily cleanable.

To clean the heat transfer plates, it has been customary to provide soot blowers which deliver a blast of high pressure air or steam through the passages between the stacked heat transfer plates to dislodge any particulate deposits from the surface thereof and carry them away leaving a relatively clean surface. One problem encountered with this method of cleaning is that the force of the high pressure blowing medium on the relatively thin heat transfer plates can lead to cracking of the plates unless a certain amount of structural rigidity is designed into the stack assembly of heat transfer plates.

One solution of this problem is to crimp the individual heat transfer plates at frequent intervals to provide folds or notches which extend outwardly away from the plate for a predetermined distance. Then when the plates are stacked together to form the heat transfer element, these folds serve not only to maintain adjacent plates at their proper distance from each other, but also to provide support between adjacent plates so that forces placed on the plates during the soot blowing operation can be equilibrated between the various plates making up the heat transfer element assembly. Many plate structures have been evolved in attempts to obtain cleanable structures with adequate heat transfer. See, for example, the following U.S. Pat. Nos.

1,823,481
2,023,965
2,438,851
2,596,642
2,983,486
3,463,222
4,396,058

However, in a heat transfer element assembly of the type having a plurality of notched plates in a stacked array, the potential exists for the folds of adjacent plates to nest. That is, the folds may all become superimposed on one another so that the spacing between adjacent plates is lost and the adjacent plates touch along their entire length. This may occur from improper installation or movement of the plates relative to each other during normal operation or during the soot blowing procedure. In any case, this nesting must be avoided as fluid flow between adjacent plates is prevented when the plates become nested.

It is, therefore, an object of the present invention to provide an improved heat transfer element assembly wherein nesting is precluded.

SUMMARY OF THE INVENTION

To the fulfillment of this object and other objects which will be evident from the description present herein, the heat transfer element assembly of the present invention comprises a plurality of first and second heat absorbent plates stacked alternately in spaced relationship thereby providing a plurality of passageways between adjacent first and second plates for the flowing of a heat exchange fluid therebetween with spacers between the plates to maintain a predetermined distance between adjacent plates. The spacers comprise folds in the first and second plates which extend outwardly therefrom a predetermined distance to contact a neighboring plate thereby maintaining plate spacing and separation.

In accordance with the present invention, the spacer folds formed in each of the heat absorbent plates are spaced equally apart with the folds in the first plates being spaced apart by a first interval and the folds in the second plates being spaced apart by a second interval which is unequal to the first interval. Preferably, the first interval is a non-integer multiple of the second interval. In this manner, the folds in adjacent first and second plates cannot line up thereby precluding nesting between adjacent plates in the stacked array of heat absorbent plates forming the heat element assembly of the present invention.

DESCRIPTION OF A PREFERRED EMBODIMENT

Figure 1:
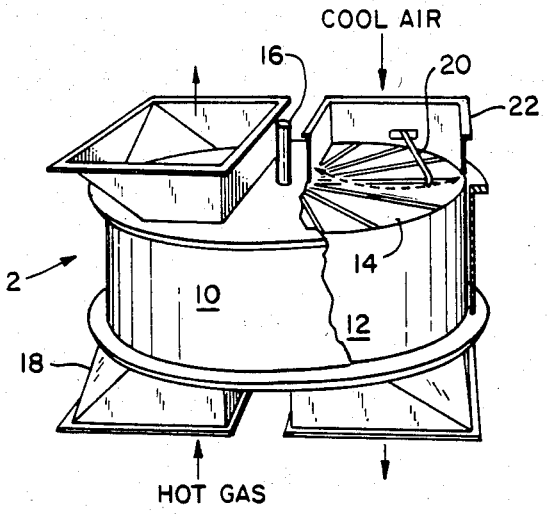
FIG. 1 is a perspective view of a rotary regenerative heat exchanger.

Referring now to the drawing and more particularly to FIG. 1, there is depicted therein a regenerative heat exchange apparatus 2 in which the heat transfer element assembly of the present invention may be utilized. The regenerative heat exchanger 2 comprises a housing 10 enclosing a rotor 12 wherein the heat transfer element assembly of the present invention is carried. The rotor 12 comprises a cylindrical shell 14 connected by radially extending partitions to the rotor post 16. A heating fluid enters the housing 10 through duct 18 while the fluid to be heated enters the housing 10 from the opposite end through duct 22.

The rotor 12 is turned about its axis by a motor connected to the rotor post 16 through suitable reduction gearing, not illustrated here. As the rotor 12 rotates, the heat transfer plates carried therein are first moved in contact with the heating fluid entering the housing through duct 18 to absorb heat therefrom and then into contact with the fluid to be heated entering the housing through duct 22. As the heating fluid passes over the heat transfer plates, the heat transfer plates absorb heat therefrom. As the fluid to be heated subsequently passes over the heat transfer plates, the fluid absorbs from the heat transfer plates the heat which the plates had picked up when in contact with the heating fluid.

As illustrated in FIG. 1, the regenerative heat exchanger 2 is often utilized as an air preheater wherein the heat absorbent element serves to transfer heat from hot flue gases generated in a fossil fuel-fired furnace to ambient air being supplied to the furnace as combustion air as a means of preheating the combustion air and raising overall combustion efficiency. Very ofen, the flue gas leaving the furnace is laden with particulate generated during the combustion process. This particulate has a tendency to deposit on the heat transfer plates particularly at the cold end of the heat exchanger where condensation of any moisture in the flue gas may occur.

In order to provide for periodic cleaning of the heat transfer element assembly, the heat exchanger is provided with a cleaning nozzle 20 disposed in the passage for the fluid to be heated adjacent the cold end of the rotor 12 and opposite the open end of the heat transfer element assembly. The cleaning nozzle 20 directs a high pressure cleaning fluid, typically steam, water, or air, through the plates as they rotate slowly while the nozzle itself sweeps across the end face of the rotor. As the high pressure fluid passes through the spaced heat transfer plates, turbulence in the fluid stream causes the heat transfer plates to vibrate so as to jar loose fly ash and other particulate deposits clinging thereto. The loosened particulate is then entrained in the high pressure fluid stream and carried out of the rotor.

Figure 2:
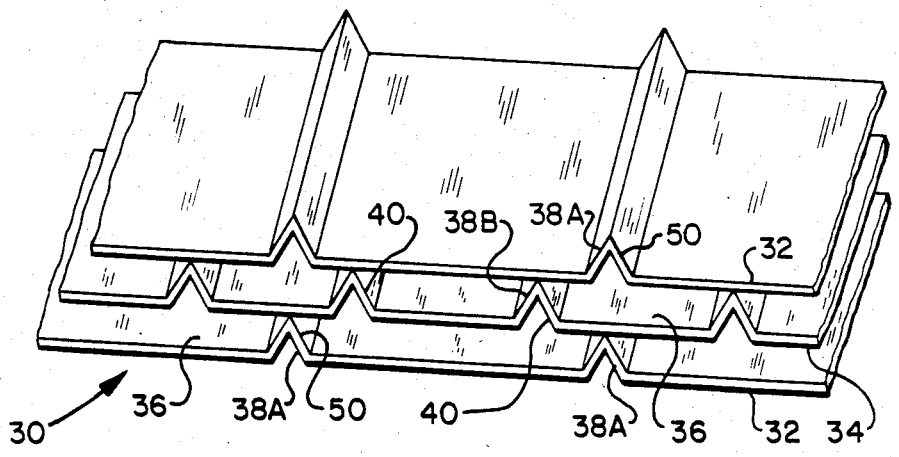
FIG. 2 is an enlarged perspective view of a heat transfer element assembly designed in accordance with the present invention.

Referring now to FIG. 2, there is depicted therein an embodiment of the heat transfer element assembly 30 designed in accordance with the present invention. As shown therein, the heat transfer element assembly is comprised of a plurality of first heat absorbent plates 32 and a plurality of second heat absorbent plates 34 stacked alternately in spaced relationship thereby providing a plurality of passageways 36 between adjacent first plates 32 and second plates 34. These passageways 36 provide a flow path for flowing a heat exchange fluid therebetween in heat exchange relationship with the plates. Spacers 38 are provided to maintain adjacent plates 32 and 34 a predetermined distance apart and keep flow passages 36 open.

The plates 32 and 34 are usually of thin sheet metal capable of being rolled or stamped to the desired configuration; however, the invention is not necessarily limited to use of metallic plates. The plates 32 and 34 may be of various surface configurations such as, but not limited to, a flat surface as illustrated in FIG. 2 or a corrugated or undulated surface, not shown. Corrugated or undulated plates provide a series off oblique furrows which are relatively shallow as compared to the distance between adjacent plates. Typically, the furrows are inclined at an acute angle to the flow of heat exchanger fluid over the plates. The corrugations of adjacent plates may extend obliquely to the line of flow of heat exchange fluid between the plates in an aligned manner or oppositely to each other.

The spacers 38A and 38B are formed by crimping the metal plates 32 and 34 to produce folds in the plates at spaced intervals. The spacer folds 38A, 38B project outwardly from the surface of the plate a predetermined distance. Preferably, each fold is in the form of a substantially V-shaped groove with the apex of the groove directed outwardly from the plate, although the fold may be in other forms such as a U-shaped or W-shaped groove. Additionally, it is preferred that the folds 38A and 38B extend transversely across the plates in alignment with the line of flow through the element assembly so that flow will be along the grooves so that the grooves do not offer a significant resistance to fluid flow through the element assembly.

In accordance with the present invention, the folds or grooves 38A in the first heat absorbent plates 32 and the folds or grooves 38B in the second heat absorbent plates 34 are spaced at different intervals. That is, the folds 38A in the first plates 32 are spaced equally apart by a first interval, while the folds 38B in the second plates 34 are also spaced equally apart but by a second internval which is not equal to the first interval at which the folds 38A in the first plate 32 are spaced. Preferably, the first interval is a non-integer multiple of the second interval.

Because the folds 38A in the first heat absorbent plates 32 are spaced equally apart at a different interval than the interval at which the folds 38B in the second heat absorbent plates 34 are equally spaced apart, the nesting of adjacent plates, which are alternate first and second plates, is precluded when the plates are stacked in juxtaposition to form the heat transfer element assembly 30 of the present invention.

While the heat transfer element assembly has been shown embodied in a rotary regenerative heat exchanger, it will be appreciated by those skilled in the art that the heat transfer element assembly of the present invention can be utilized in a number of other heat exchanger apparatus not only of the regenerative type but also of the recuperative type. Additionally, various plate configurations, some of which have been alluded to herein, may be readily incorporated into the heat transfer element assembly of the present invention by those skilled in the art. We, therefore, intend by the appended claims to cover the modifications alluded to herein as well as all other modifications which may fall within the true spirit and scope of the present invention.

I claim:

1. An assembly of heat transfer elements for a heat exchanger comprising: a plurality of first heat absorbent plates, a plurality of second heat absorbent plates, and a plurality of spacers, said plurality of first and second heat absorbent plates stacked alternatively in spaced relationship with said spacers interdisposed therein to maintain a predetermined spacing between adjacent plates thereby providing a plurality of passageways between first and second stacked plates for flowing a heat exchange fluid therebetween, said spacers comprising a plurality of folds in said first and second plates extending transversely across the width thereof, the folds in said first plates extending outwardly therefrom at a plurality of points spaced equally apart by a first interval and the folds in said second plates extending outwardly therefrom at a plurality of points spaced equally apart by a second interval, said first interval and said second interval being unequal to each other.

2. An assembly of heat transfer element as recited in claim 1 wherein said first interval at which the folds in said first plates are spaced equally apart is a non-integer multiple of said second interval at which the folds in said second plates are spaced equally apart.

* * * * *